United States Patent [19]

Riedel

[11] 4,078,824

[45] * Mar. 14, 1978

[54] AUTOMATIC SKI BRAKE USING STIRRUP-SHAPED SPRING WIRE

[75] Inventor: Tilo Riedel, Eching, Germany

[73] Assignee: S.A. Etablissements Francois Salomon & Fils, Annecy, France

[ * ] Notice: The portion of the term of this patent subsequent to Jun. 22, 1993, has been disclaimed.

[21] Appl. No.: 665,788

[22] Filed: Mar. 10, 1976

Related U.S. Application Data

[63] Continuation-in-part of Ser. No. 557,476, March 12, 1975, Pat. No. 3,989,271.

[30] Foreign Application Priority Data

| | | |
|---|---|---|
| Mar. 15, 1974 | Germany | 2412623 |
| Jul. 26, 1974 | Germany | 2436155 |
| Feb. 20, 1975 | Germany | 2507371 |

[51] Int. Cl.[2] ..... A63C 7/10

[52] U.S. Cl. ..... 280/605

[58] Field of Search ..... 280/605, 604

[56] References Cited

U.S. PATENT DOCUMENTS

| | | | |
|---|---|---|---|
| 3,884,487 | 5/1975 | Wehrli | 280/605 |
| 3,964,760 | 6/1976 | Riedel | 280/605 |
| 3,989,271 | 11/1976 | Riedel | 280/605 |

*Primary Examiner*—David M. Mitchell

*Attorney, Agent, or Firm*—Karl F. Ross

[57] ABSTRACT

A device for braking a ski upon the release thereof from a ski boot which comprises a mounting plate affixed to the upper surface of the ski and a preferably one-piece U-shaped stirrup of spring wire having a bight and a pair of offset shanks received in and swingably mounted on the mounting plate. Upon depression of the bight of the spring-wire stirrup by the ski boot, the stirrup is deformed and swings a pair of brake elements or blades into an inoperative position parallel to the longitudinal edges of the ski. The deformation of the stirrup, because of nonplanarity of the stirrup or camming formations on the mounting plate, provides a prestress thereto which, upon release of the stirrup by the ski boot, causes the brake elements to swing into an operative position where they inhibit free flight of the ski.

13 Claims, 6 Drawing Figures

AUTOMATIC SKI BRAKE USING STIRRUP-SHAPED SPRING WIRE

CROSS-REFERENCE TO RELATED APPLICATION

This application is a continuation-in-part of my copending application Ser. No. 557,476 filed Mar. 12, 1975 and entitled "AUTOMATIC BRAKE FOR SKI", U.S. Pat. No. 3,989,271 issued Nov. 2, 1976.

FIELD OF THE INVENTION

The invention relates to a device for braking the free flight of a ski upon release thereof from a ski boot, e.g. upon falling of the skier, the ski brake having, more particularly, a swingable brake element mounted on the outer surface of the ski, e.g. by means of a mounting plate.

BACKGROUND OF THE INVENTION

As described more fully in the above-identified application, a ski which is released from a ski boot on a slope, e.g. upon the falling of a skier, can engage in free flight and, at high speeds, poses a danger to other skiers. For this reason it has been proposed to provide the ski with an automatic brake which is retained in an inoperative position by application of the ski boot against the ski, e.g. against a spring force tending to bias an actuator into an inoperative position. The actuator may be engaged by the toe or heel of the ski boot when the latter is properly received in the ski binding.

The actuator is generally provided with one or two brake elements which can be constituted as blades and swing from their inoperative positions, in which they permit ordinary skiing, into operative positions in which they engage the ground and prevent further free flight of the ski when the actuator is released by the ski boot.

Such devices are termed hereinafter generically as ski brakes and, in one such ski brake, which is mounted behind the binding in a bearing or journal arrangement, the pivot axis includes an acute angle with the longitudinal axis of the ski and the basic spring force is generated by a torsion spring which acts upon a blade-like brake element.

In another conventional construction, leaf springs are secured at their forward ends to the ski and at their rearward ends tend to bend upwardly when they are unloaded. Upon loading by the ski boot, these spring elements are urged towards the upper surface of the ski to swing the blades into positions generally parallel to the ski edges as described in Austrian Pat. No. 299,036.

Other ski brakes are described in Austrian Pat. Nos. 280,867 and 210,804, although these devices are somewhat more remote from the present invention than the prior art devices described above and hence require no detailed discussion.

Austrian Pat. No. 305,844 describes a ski brake having a spring which, upon release of an actuator, rotates a shaft extending transversely to the ski about the shaft axis to bring the blade into play.

German published application (Offenlegungsschrift) No. 2,417,279 describes a ski brake which is mounted by a support plate on the upper surface of the ski. In one recess of this support plate, a circular-cross-section wire is pivotally journaled and is formed as one of two pivot shafts. One end of the circular-cross-section wire forms a brake spur while another region of the wire is bent into a retaining hoop, the free end of the hoop being formed as a second shaft journaled in a further recess of the support plate. It is important, in this construction, that the two journaling recesses in the support plate be exactly parallel, a factor which increases the fabrication cost and causes difficulties with respect to mounting or operation if precision is not achieved. These two journaling recesses impart an elastic prestress to the circular-cross-section wire so that the braking spur automatically springs into the operative position when the wire is released by the ski boot.

OBJECTS OF THE INVENTION

It is the principal object of the present invention to provide a ski brake which extends the principles set forth in the above-identified application.

It is another object of the invention to provide a ski brake for the purposes described which is simple in construction and relatively inexpensive.

It is still another object of the invention to provide a ski brake which is not subject to damage, cannot ice up, and has no parts which fit within one another and tend to bind or lock against operational movement.

Yet another object of the invention is to provide an improved highly simplified and thoroughly dependable ski brake.

SUMMARY OF THE INVENTION

These objects are achieved, in accordance with the invention, by using as the actuator and the spring means for a ski brake a stirrup-shaped, preferably unitary (one-piece), bent wire member having a bight portion lying in one plane and at least one but preferably two offset (bent) shanks. The offset portions are swingably mounted in a mounting plate fixed to the upper surface of the ski and a pair of brake elements (or at least one brake element) is mounted on the shanks (or shank) of the stirrup-shaped member.

Because the offset portion or portions lie in a plane (second plane) which is different from the plane of the bight portion, a downward pressing movement of the bight results in distortion of the offset portions which are retained in the mounting plate and thereby impart a spring bias to the stirrup tending to swing the same about the respective offset portions to bring the brake element or elements (blade or blades) into play. When the bight is pressed against the surface of the ski by the sole of the ski boot, the offset portions and the bight tend to lie in a single plane. However, in a relaxed condition (released position) of the stirrup, the offset portions lie in a plane other than the plane of the bight.

Hence the self-stressing of the wire, upon its deformation by the downward pressure of the sole of the ski boot, creates the spring bias which causes the subsequent upward movement of the bight when the latter is not loaded by the sole of the ski boot.

According to another feature of the invention, the offset portion or portions are bent outwardly (i.e. toward the longitudinal edges of the ski) at angles to the portions of the shank which extend to the bight which deviate from a right angle, i.e. at obtuse angles to the non-offset portions of the shank lying in the plane of the bight. The offset portions of the shanks thus include acute angles with the corresponding longitudinal edges of the ski.

BRIEF DESCRIPTION OF THE DRAWING

The above and other objects, features and advantages of the present invention will become more readily apparent from the following description, reference being made to the accompanying drawing in which.

SPECIFIC DESCRIPTION

Since the present application is directed to a portion of the subject matter set forth in the above-identified copending application, for all subject matter requiring further elucidation reference is made to the parent application which is included herein by reference.

Figure 1:
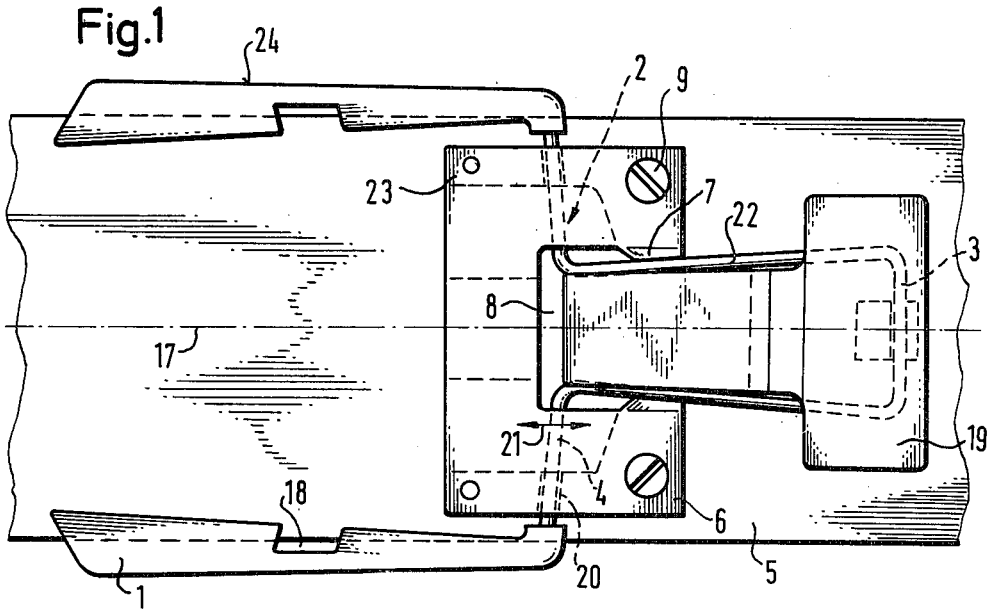
FIG. 1 is a plan view of a portion of a ski provided with a ski brake in accordance with the present invention, the brake being shown in a depressed or inoperative position as if held downwardly by a ski boot.
Figure 4:
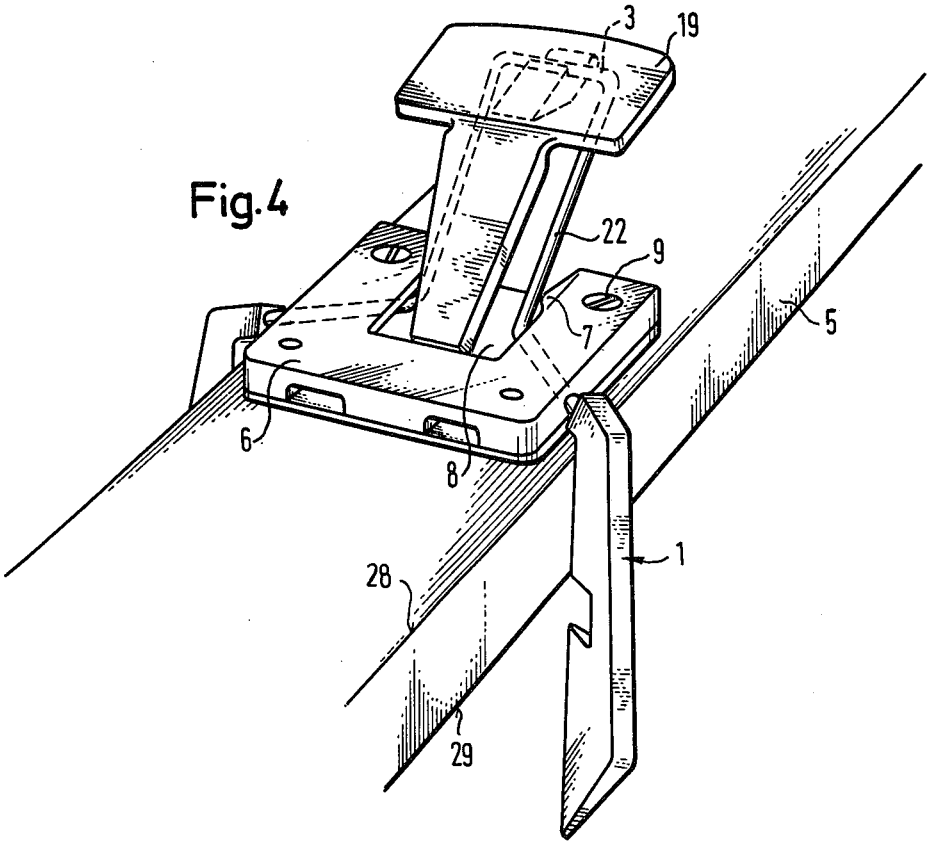
FIG. 4 is a perspective view of the ski brake of FIG. 1 after the latter has been released by the sole of the ski boot.

As can be seen from FIGS. 1 and 4, the upper surface of a ski 5 is provided with a mounting plate 6 by means of screws. The mounting plate is formed with a central recess 8 and a pair of outwardly diverging guide passages 20 which lie in a plane parallel to the plane of the ski surface. The guide passages 20 receive outwardly and downwardly diverging offset portions 4 of a stirrup-shaped spring wire which is formed with an elongated bight 3. The bight 3 extends through the recess 8 toward the rear of the ski and can swing between a position in which it is substantially parallel to the surface of the ski (FIG. 1) and a position in which it is upstanding therefrom.

The guide passages 20 have dimensions such that they permit pivotal movements of the offset portions 4 to swing a pair of brake elements 1 upwardly so as to lie along the longitudinal edges of the ski and downwardly so as to flank the lateral edges and engage the snow surface along which the ski may travel. The passages 20 are further dimensioned so that, upon depression of the bight 3, the stirrup-shaped bent wire is given a prestress which resiliently biases it into its operative position shown in FIG. 4 from the inoperative position illustrated in FIG. 1 in which the bight is held down against the upper surface of the ski by the sole of the ski boot.

Thus when the ski boot is applied to the bight portion 3 of the stirrup-shaped bent wire, which is provided with a tread plate 19 swingably mounted in the recess 8, the bight 3 is urged downwardly and deformed so that the intrinsic deformation provides an intrinsic spring force tending to swing the bight upwardly.

Along the lateral flanks of the recess 8 there are provided camming formations 7 which bear upon the shanks 22 of the bight 3 to urge the shanks toward one another and toward the median longitudinal plane or axis 17 of the ski. This movement swings the brake blades 1, affixed to the downwardly turned ends of the offset portions 4 to overlie the upper surface of the ski along the longitudinal edges thereof.

While the cams may be simply sloping surfaces, it has been found that an arcuate cross-sectional configuration is more desirable to facilitate the swinging of the blades 1 in the last phases of their movement onto the ski surfaces. When, of course, the bight 3 is permitted to swing upwardly, the cams 7 release the shanks 22 and permit the blades 1 to swing outwardly to straddle the longitudinal edges of the ski.

In the embodiment illustrated in FIG. 1, the mounting plate 6 is provided with webs 23 in which the passages 20 are formed. The passages 20 can also be formed completely or partly in the ski structure itself. The webs 23 serve simultaneously as facing elements which can hold an upper part of the mounting plate in proper relationship to a lower portion thereof or can be unitary with a one-piece mounting plate. The webs can have a thickness of, for example, the thickness of the wire 2. The screws securing the mounting plate 6 to the ski surface are represented at 9 in FIG. 1.

It has been found to be most advantageous to make the entire stirrup-shaped bent wire as a single piece.

When the ski brake is in the position shown in FIG. 4, notches 18 in the blades 1 serve to coact with another ski of a pair placed with their runner surfaces in contact. This allows the skis to be joined together in pairs for transportation or storage without any straps or other means.

Figure 2:
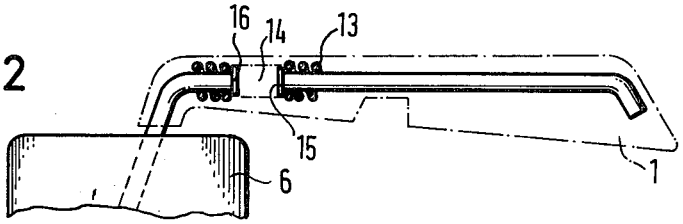
FIG. 2 shows an arrangement, in a fragmentary detail view, with parts broken away, of the connection between a brake element and the stirrup wire whereby a secondary spring member is provided between the brake element and the stirrup which forms a primary spring element.

In FIG. 2 the spring wire connecting the blade 1 with the stirrup is interrupted at 14, the spaced-apart ends being joined by a secondary spring element in the form of a coil spring 13. For this purpose the ends of the spring wire can be provided with plates 15 and 16 receivable by turns of the coil spring 13 to permit adjustment of the spacing. The ends of the spring wires may be received in the coil spring 13 with a simple press fit or can be bonded thereto. The additional spring element 13 provides greater resiliency between the stirrup and the blade 1 so that any impact on the braking element can be cushioned and breakage of the system can be avoided. This can be achieved by connecting a thinner wire to the wire 2 of the blade 1. Here the moduluses of elasticity of the two wires will be different (see the above-identified copending application).

Figure 3:
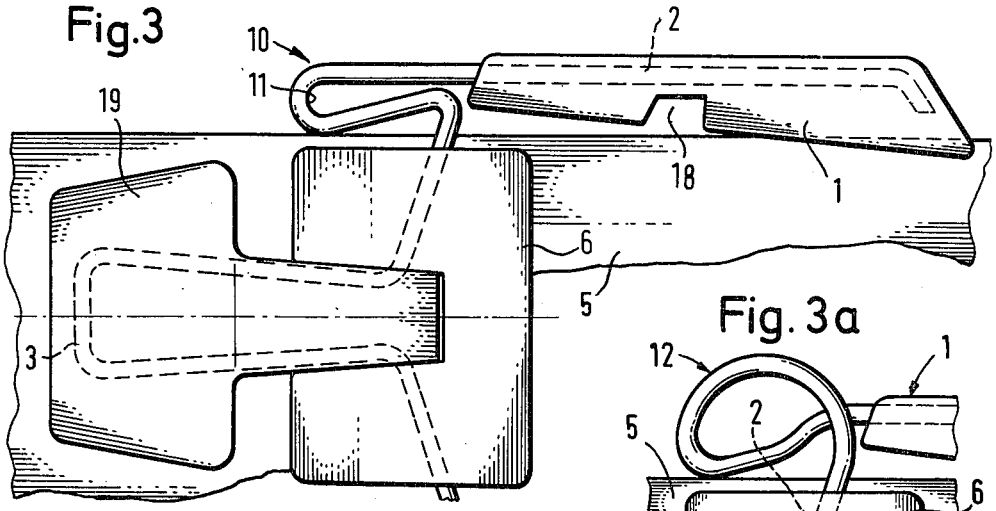
FIG. 3 shows, in a view generaly similar to FIG. 2 but revealing more of the ski surface and the stirrup-shaped member, another embodiment of a secondary spring element, here formed by bending a loop in the stirrup wire.
Figure 3A:
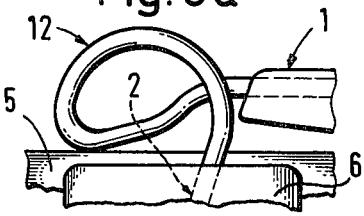
FIG. 3A is another detail view showing an alternative to the construction of FIG. 3.

FIGS. 3 and 3A show an arrangement whereby the additional spring action is provided by either an elongated loop 11 or a spiral formation 12, generally designated as a secondary spring element 10 at the transition between the stirrup member 2 and the brake element 1.

The end of the stirrup-shaped spring wire 2 can be embedded within the brake blade 1 or can be affixed to the latter.

While in the embodiment of FIGS. 1 and 4 the tread plate 19 is clamped to the bight 3, in the embodiment of FIG. 3 the tread plate 19 merely rests thereon. The device nonetheless functions as previously described.

In all of the embodiments described it should be noted that the passage 20 and the mounting plate 6 generally should be dimensioned so that the stirrup 2 has a freedom of movement parallel to the axis 17, i.e. as represented by the arrow 21.

FIG. 4 shows the ski brake in its operative position when the bight 3 and the tread plate 19 are not loaded by the sole of a ski boot. In this position the intrinsic spring force of the wire 2 swings the stirrup into a position in which it lies generally transversely to the surface of the ski with the plane of the blades 1 being likewise transverse to the ski planes. The upper surface of the ski is represented at 28 while the lower surface or runner is shown at 29.

Figure 5:
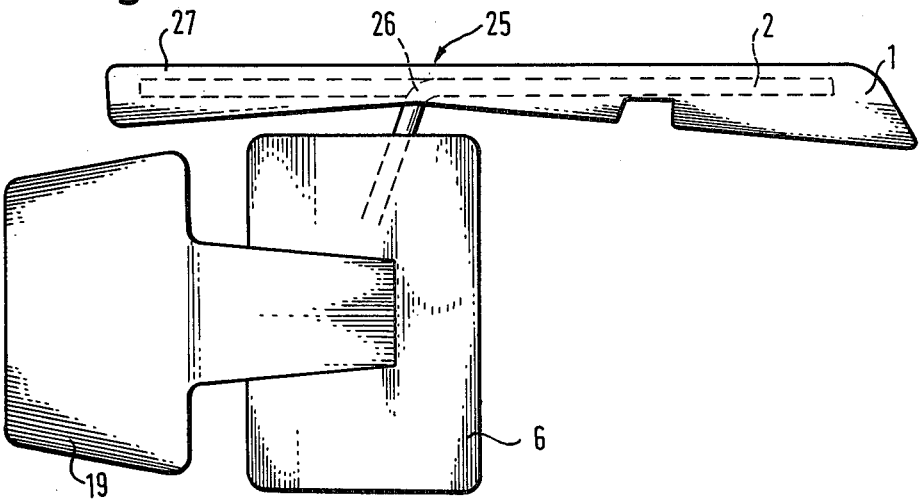
FIG. 5 is a plan view of a ski brake provided with a modified brake element which projects beyond the point at which the brake element is joined to the spring wire of the stirrup.

FIG. 5 illustrates an embodiment of the invention in which the blade 1 receives the spring wire 2 of the stirrup as described in connection with FIGS. 1 - 4 but, in addition, the blade is extended at 27 rearwardly of the junction of the blade 1 with the offset portion 4 of the stirrup-forming wire. This junction is represented at 25.

A wire can also extend through the prolongation 27 and can be welded to the stirrup wire at the region 26. This arrangement permits the prolongation 27 of the blade elements to act as a tread surface which can be depressed by the sole of the ski boot in addition to the tread plate 19 for a rapid elevation of the brake element 1 into its inoperative position.

It has been found that this construction is desirable when the bight 3 of the stirrup-shaped member must be relatively short. Since the bight does not here act as the only actuating element, it can be reduced in size so that it has the dimensions necessary only to provide the characteristic spring force for swinging the blade 1 downwardly. It does not have to act as a lever arm for raising the brake elements. It is also conceivable that the tread plate 19 can be eliminated in this latter embodiment.

I claim:

1. A ski brake for mounting upon a ski comprising:

a mounting plate affixed to the upper surface of the ski;

a stirrup-shaped spring wire swingably mounted in said mounting plate and provided with a bight portion positioned above the upper surface of the ski and having a pair of shanks connected by a bight, a pair of offset legs extending outwardly from the respective shanks, and a pair of brake portions extending at angles to the respective legs, the brake portions straddling opposite longitudinal edges of the ski, said legs pivotally mounting said wire for swinging movement in said plate;

respective brake elements fixed to said brake portions and engageable with the ground, said bight portion lying in one plane and said offset legs lying in another plane whereby swinging of the wire about said legs to displace said bight portion toward said surface deforms said wire elastically, said bight portion being positioned for engagement by a ski boot attached to the ski; and cooperating means on said stirrup-shaped spring wire and said mounting plate for deforming said stirrup-shaped spring wire to swing said brake elements inwardly to overlie the upper surface of said ski in an inoperative position of the ski brake upon the depression thereof by a ski boot, said stirrup-shaped spring wire being elastically deformed in said inoperative position to provide a resilient bias tending to swing said brake elements outwardly and downwardly to engage a ground surface upon release of said brake by said ski boot.

2. The ski brake defined in claim 1 wherein said cooperating means includes cam means on said mounting plate for biasing said shanks inwardly upon depression of said bight toward the upper surface of said ski.

3. The ski brake defined in claim 2 wherein said plate is provided with a central recess having opposite flanks, said bight portion projecting from said recess.

4. The ski brake defined in claim 3 wherein said cam means are camming formations provided along the flanks of said recess.

5. The ski brake defined in claim 1 wherein said legs diverge outwardly toward the front of the ski and include angles different from 90° with the longitudinal edges thereof.

6. The ski brake defined in claim 1 wherein said legs are provided at their ends with bends terminating in extremities constituting said brake portions running approximately parallel to the longitudinal edges of the ski.

7. The ski brake defined in claim 1 wherein said plate comprises at least two superposed plate members.

8. The ski brake defined in claim 1 wherein said mounting plate is provided with passages accommodating said offset legs.

9. The ski brake defined in claim 1, further comprising an elastic element interposed between at least one of said brake elements and said stirrup-shaped spring wire for cushioning the latter upon impact of a foreign body with said one of said brake elements.

10. The ski brake defined in claim 9 wherein said stirrup-shaped bent wire terminates in the region of said one of said brake elements and a further wire portion is provided on said one of said brake elements but spaced from the end of the stirrup-shaped bent wire, said elastic element comprising a coil spring bridging ends of said wires in the region of the junction between the brake element and said stirrup-shaped spring wire.

11. The ski brake defined in claim 9 wherein said elastic element is a loop formed in said stirrup-shaped spring wire in the region between the junction of said one of said brake elements and one of said offset legs.

12. The ski brake defined in claim 1 wherein said stirrup-shaped spring wire is connected to one of said brake elements by a thinner wire of a modulus of elasticicity which is different from the thicker stirrup-shaped spring wire.

13. The ski brake defined in claim 1, further comprising a tread plate pivotably connected to said bight.

* * * * *

Disclaimer 4,078,824.—*Tilo Riedel,* Eching, Germany. AUTOMATIC SKI BRAKE USING STIRRUP-SHAPED SPRING WIRE. Patent dated Mar. 14, 1978. Disclaimer filed Mar. 2, 1981, by the assignee, *S. A. Etablissements Francois Salomon & Fils.*

The term of this patent subsequent to June 22, 1993, has been disclaimed. [*Official Gazette April 7, 1981.*]